US008413802B2

(12) United States Patent
Lee et al.

(10) Patent No.: US 8,413,802 B2
(45) Date of Patent: Apr. 9, 2013

(54) PRESSURIZATION TYPE CAP ASSEMBLY HAVING STORAGE CHAMBER FOR SECONDARY MATERIAL

(76) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 0 days.

(21) Appl. No.: 12/520,415

(22) PCT Filed: Dec. 13, 2006

(86) PCT No.: PCT/KR2006/005427

§ 371 (c)(1),
(2), (4) Date: Jun. 19, 2009

(87) PCT Pub. No.: WO2007/073055

PCT Pub. Date: Jun. 28, 2007

(65) Prior Publication Data

US 2010/0025268 A1 Feb. 4, 2010

(30) Foreign Application Priority Data

| | | |
|---|---|---|
| Dec. 19, 2005 | (KR) | 10-2005-0126602 |
| Dec. 19, 2005 | (KR) | 10-2005-0126606 |
| Dec. 19, 2005 | (KR) | 10-2005-0126609 |
| Dec. 19, 2005 | (KR) | 10-2005-0126617 |
| Dec. 19, 2005 | (KR) | 10-2005-0126618 |
| Dec. 19, 2005 | (KR) | 10-2005-0126621 |
| Dec. 19, 2005 | (KR) | 10-2005-0126622 |
| Dec. 19, 2005 | (KR) | 10-2005-0126624 |
| Dec. 19, 2005 | (KR) | 12-2005-0126625 |
| Jan. 27, 2006 | (KR) | 10-2006-0009527 |
| Jan. 27, 2006 | (KR) | 10-2006-0009528 |
| Jan. 27, 2006 | (KR) | 10-2006-0009529 |
| Jan. 27, 2006 | (KR) | 10-2006-0009530 |
| Jan. 27, 2006 | (KR) | 10-2006-0009532 |
| Feb. 2, 2006 | (KR) | 10-2006-0011406 |
| Feb. 9, 2006 | (KR) | 10-2006-0013510 |
| Feb. 9, 2006 | (KR) | 10-2006-0013512 |
| Feb. 9, 2006 | (KR) | 10-2006-0013514 |
| Mar. 2, 2006 | (KR) | 10-2006-0021209 |
| Mar. 3, 2006 | (KR) | 10-2006-0021216 |
| Mar. 3, 2006 | (KR) | 10-2006-0021217 |

(51) Int. Cl.
*B65D 25/08* (2006.01)

(52) U.S. Cl.
USPC ..... 206/221; 206/219

(58) Field of Classification Search ..... 206/219, 206/220, 221, 568; 215/DIG. 8; 222/94, 222/145.5, 145.6
See application file for complete search history.

(56) References Cited

U.S. PATENT DOCUMENTS

| | | | | |
|---|---|---|---|---|
| 937,049 | A | 10/1909 | Callahan | |
| 2,636,493 | A * | 4/1953 | Lockhart | 604/90 |

(Continued)

FOREIGN PATENT DOCUMENTS

| | | |
|---|---|---|
| JP | 2003-002350 | 1/2003 |
| KR | 200285759 | 8/2002 |
| WO | WO 03/059774 A2 | 7/2003 |

OTHER PUBLICATIONS

International Search Report for PCT/KR2006/05427 filed Dec. 13, 2006; mailed Apr. 13, 2007; 2 pages.

*Primary Examiner* — David Fidei
(74) *Attorney, Agent, or Firm* — Westman, Champlin & Kelly, P.A.

(57) ABSTRACT

The present invention relates to a cap assembly mounted on a discharging portion of a container for containing an ingredient different from that in accommodated in a container, which comprise a cap body having a housing formed with a chamber for storage of a secondary ingredient, a closing element provided at a lower end opening of the housing for opening the lower end opening under pressure so as to open the lower end opening.

6 Claims, 29 Drawing Sheets

U.S. PATENT DOCUMENTS

| | | | | | |
|---|---|---|---|---|---|
| 2,764,157 | A | * | 9/1956 | Oliva et al. | 206/221 |
| 3,163,163 | A | * | 12/1964 | Wilburn | 206/221 |
| 3,246,807 | A | * | 4/1966 | Micallef | 222/207 |
| 3,314,563 | A | * | 4/1967 | Mounier | 206/221 |
| 4,062,477 | A | * | 12/1977 | Morane | 222/129 |
| 5,152,965 | A | * | 10/1992 | Fisk et al. | 422/547 |
| 5,352,196 | A | * | 10/1994 | Haber et al. | 604/90 |
| 6,045,254 | A | | 4/2000 | Unbar et al. | 366/130 |
| 6,068,165 | A | * | 5/2000 | Minihane et al. | 222/454 |
| 6,148,996 | A | | 11/2000 | Morini et al. | 206/222 |
| 6,527,110 | B2 | * | 3/2003 | Moscovitz | 206/222 |
| 7,055,685 | B1 | * | 6/2006 | Patterson et al. | 206/220 |
| 2002/0066679 | A1 | * | 6/2002 | Moscovitz | 206/221 |
| 2004/0060831 | A1 | * | 4/2004 | De Laforcade | 206/219 |

* cited by examiner

[Fig. 14]

PRESSURIZATION TYPE CAP ASSEMBLY HAVING STORAGE CHAMBER FOR SECONDARY MATERIAL

CROSS-REFERENCE TO RELATED APPLICATION

The present application is a Section 371 National Stage Application of International patent application Serial No. PCT/KR2006/005427, filed Dec. 13, 2006, and published as WO 2007/073055 on Jun. 28, 2007, in English the content of which is hereby incorporated by reference in its entirety.

TECHNICAL FIELD

The present invention relates to a cap assembly for closing a container and more particularly to a cap assembly having a storage chamber for containing a secondary material(ingredient) for example a concentrated liquid or a granule different from a material(ingredient) for example water or a beverage accommodated in a container.

Such a cap assembly is useful in the various industrial fields such as medical, pharmaceutical, cosmetic and etc.

BACKGROUND ART

Generally, when a beverage that requires mixing up a liquid in a container with a granule or a concentrate liquid as additives or secondary ingredients such as carbon dioxide, vitamin powder, etc, it is often necessary that the container has a separate chamber for storage the secondary ingredients.

There are many suggestions more than 5,000 including U.S. Pat. No. 937,049(filed on Oct. 19, 1909) about the structure for mixing two or more ingredients in a container.

However, the containers disclosed in the above patents have not commercially succeeded because of the problems such as inefficiency in a manufacture process, inconvenience in use, etc.

There are further needs for more easily handling of a cap assembly and a container for mixing one or more ingredients in an ingredient contained in a container without problems of changing a structure or an injury of an elbow caused by acting an excessive force to open a discharging device for use.

Recently, PCT/EP2002/004523 filed on Jan. 17, 2002 and Japanese Patent Application No. 2001-00185428 filed on Jun. 19, 2001 suggested other structure, but a commercial success has not been obtained.

Particularly, the structure disclosed in Japanese Patent Application mentioned above has a problem that a piece cut out from a discharging port falls into a container and a child may swallow it. To overcome this problem, a discharging device which is not separated from a novel neck of a container has been developed, but such a discharging device could not be used to a conventional neck of a container.

Furthermore, there is a discharging device which is maintained at a neck of a container with a pressure in the container and is opened when the pressure is removed in the container. However, such a discharging device can not be used at a container in which a pressure is not applied.

Also, there is an impacting device which is adapted to rupture a sealing film by shaking it for use so as to discharge a secondary ingredient from a storage chamber into a container, but there is a problem that the impacting device is likely to open the storage chamber by an unexpected small impacting.

To prevent the accidental opening the storage chamber, the impacting device should be tightly assembled. However, in this case, another problem that the weight of the impacting device should be increased is caused.

DISCLOSURE OF INVENTION

Technical Problem

In view of the above, an object of the present invention is to provide a cap assembly with a storage chamber for a secondary ingredient to be conveniently mixed with a primary ingredient contained in a container under the pressurized condition.

Another object of the present invention is to provide a cap assembly adapted to a conventional container without change thereof.

Technical Solution

In order to accomplish the above-mentioned objects, according to the present invention, a cap assembly is mounted on a discharging portion of a container for containing an ingredient different from that in accommodated in a container, comprising:

a cap body having a housing formed with a chamber for storage of a secondary ingredient;

a closing element provided at a lower end opening of the housing for opening the lower end opening under pressure so as to open the lower end opening.

When the container is pressed, the closing element sealing the lower end opening may be raised for opening a lower end opening so as to discharge the secondary ingredient through the lower end opening to be mixed with the primary ingredient in the container.

BRIEF DESCRIPTION OF THE DRAWINGS

The above objects, other features and advantages of the present invention will become more apparent by describing the preferred embodiments thereof with reference to the accompanying drawings, in which.

BEST MODE FOR CARRYING OUT THE INVENTION

Figure 1:
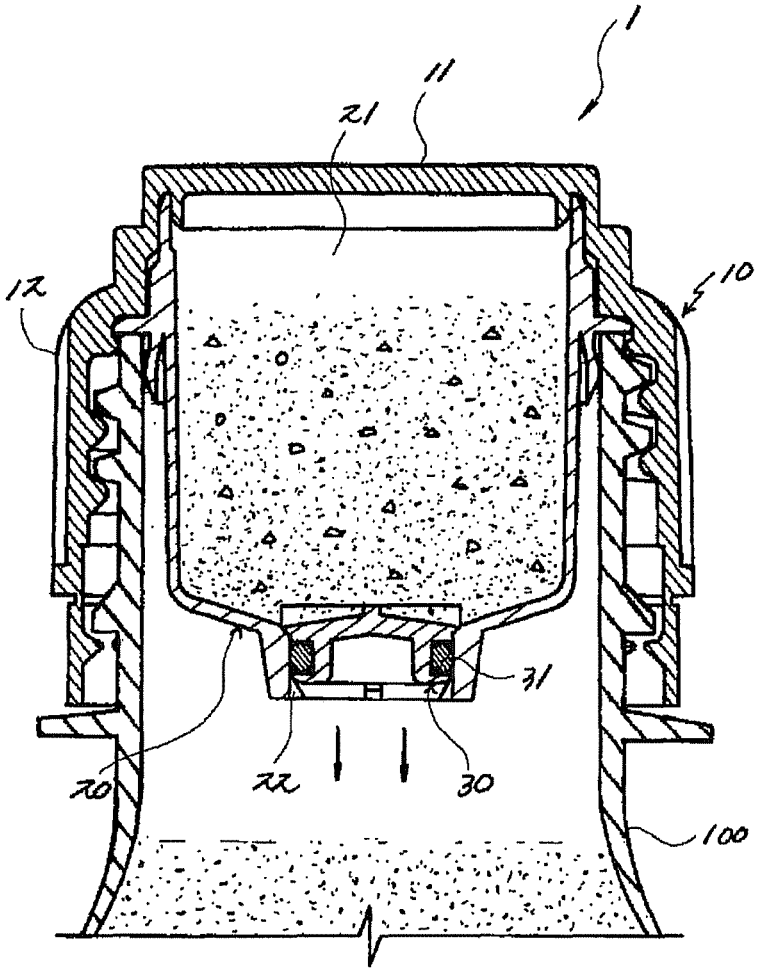
FIG. 1 is a cross-sectional view of cap assembly in accordance with a first embodiment of the present invention, which is mounted at a neck of an evacuated container.
Figure 2:
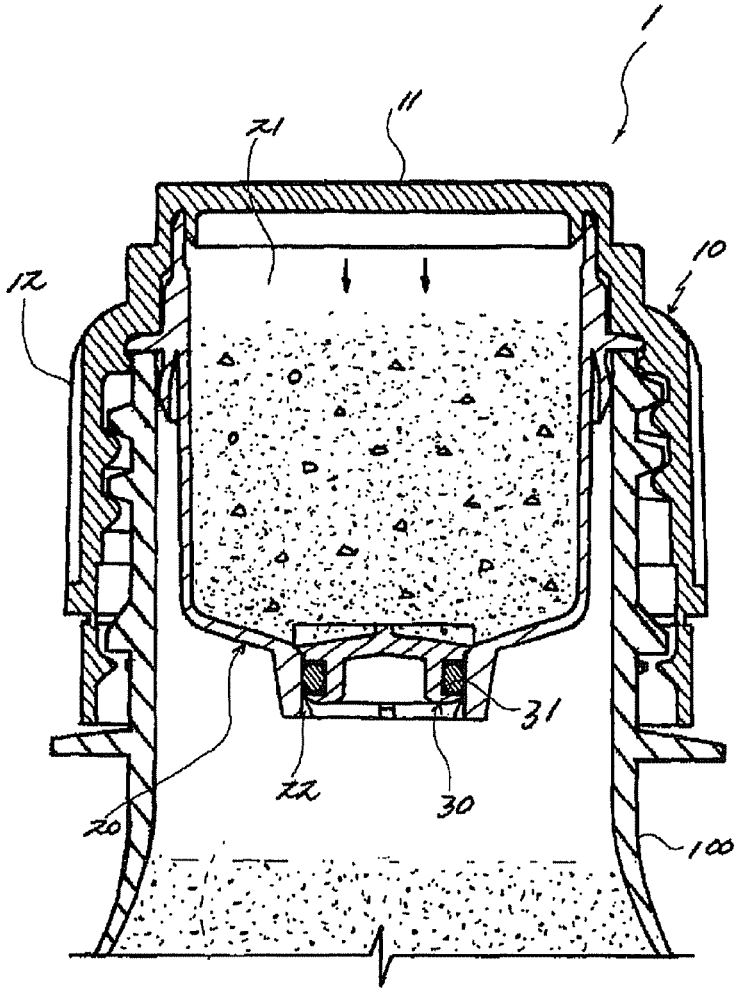
FIG. 2 shows the cap assembly in FIG. 1, of which the housing is in a pressurized condition.

Reference will now be made to the drawings to describe the resent invention in detail. In the following description of the present invention, the same drawing reference numerals are used for the same elements even in different drawings, and the duplicate explanation thereof will be omitted.

FIG. 1 shows a cap assembly 1 in accordance with the preferred embodiment of the present invention, which may be mounted to a neck of a container for example a beverage container in such a way of a conventional thread engagement, a snap-fit engagement or adhering type.

The cap assembly in FIG. 1 comprises a cap body 10, which comprises a top portion 11 and a cylindrical portion 12, including a housing 20 formed with a chamber 21. The housing 20 has a lower end opening 22 which is sealed by a closing element 30.

The chamber 21 contains a secondary ingredient with the lower end opening sealed by the closing element 30 such that the closing element 30 is moved to open the lower end opening by putting pressure on a container.

The closing element 30 is provided with a sealing member 31 and the pressure for opening the lower end opening of the housing may be changed according to the engaging force between the sealing member 31 and the inside surface of the lower end.

It is preferred to assemble the housing 20 to the cap body 10 with a secondary ingredient contained in the chamber 21.

As shown in FIG. 1, the cap assembly with the housing having the secondary ingredient in the chamber is mounted to the neck of the container 100 which contains a primary ingredient under the reduced pressure or evacuated condition.

When the container 100 is pressed for use, the closing element 30 is pushed under the increased pressure in the container into the housing and thus the lower end opening 22 of the housing 20 is opened, thereby discharging the secondary ingredient in the chamber 21 into the container so that the primary ingredient in the container and the secondary ingredient may be mixed.

According to my observation, the opening speed of the closing element 30 is changed according to the amount of the secondary ingredient contained in the chamber 21.

Also, the opening speed of the closing element 30 may be changed according to the size of the lower end opening 22.

When the chamber 21 is under pressure, the open speed of the closing element 30 is decreased. When the container 100 is evacuated, the discharging speed of the secondary ingredient from the chamber 21 into the container is increased.

Furthermore, the container 100 is more strongly pressed, the discharging of the secondary ingredient from the chamber into the container is speedier.

Figure 3:
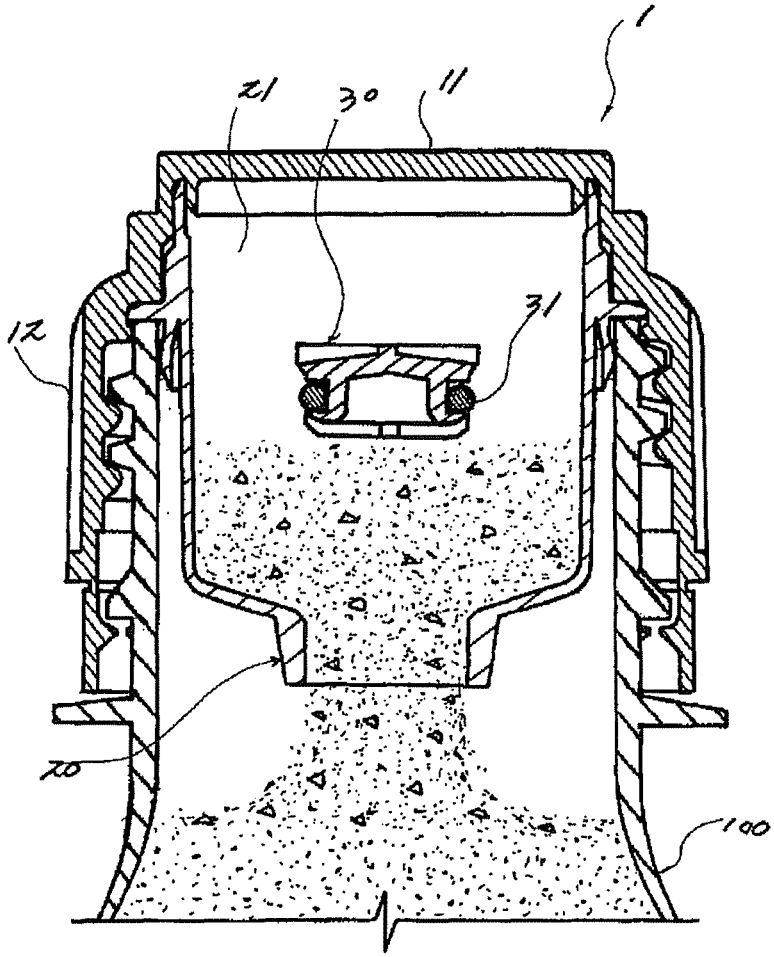
FIG. 3 shows the opening process of the housing for discharging a secondary ingredient from FIGS. 1 and 2.
Figure 4:
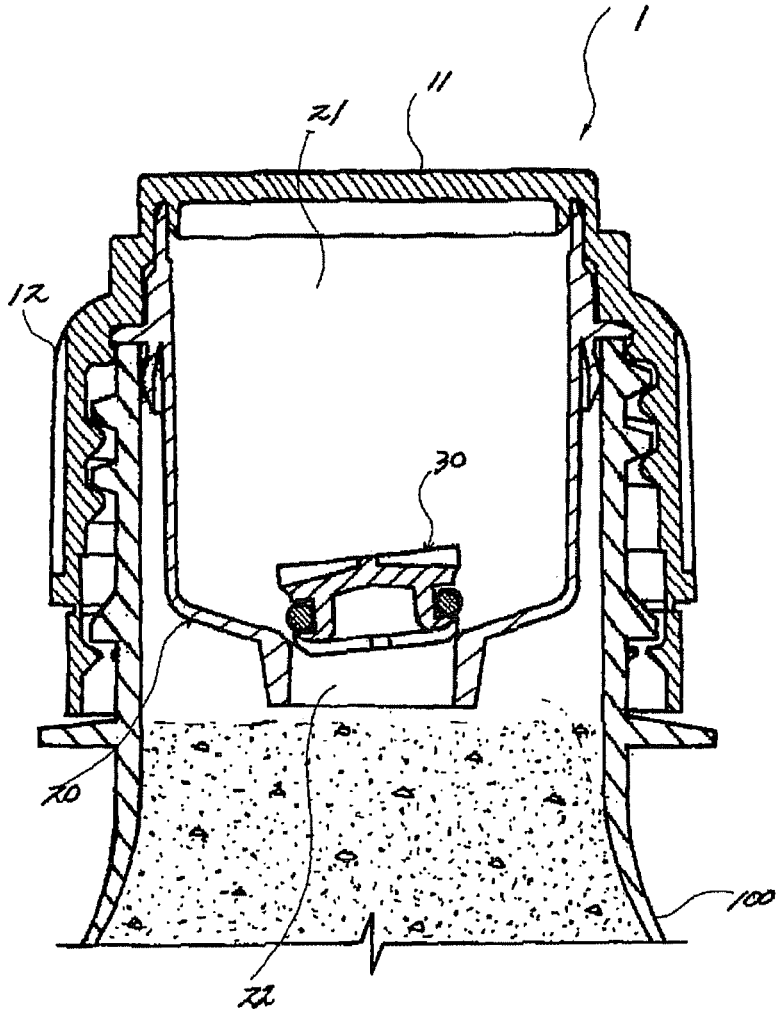
FIG. 4 shows a complete opening state of the housing of the cap assembly.

The opening procedures of the closing element 30 by the pressing of the container 100 are shown in FIGS. 3 and 4.

Figure 5:
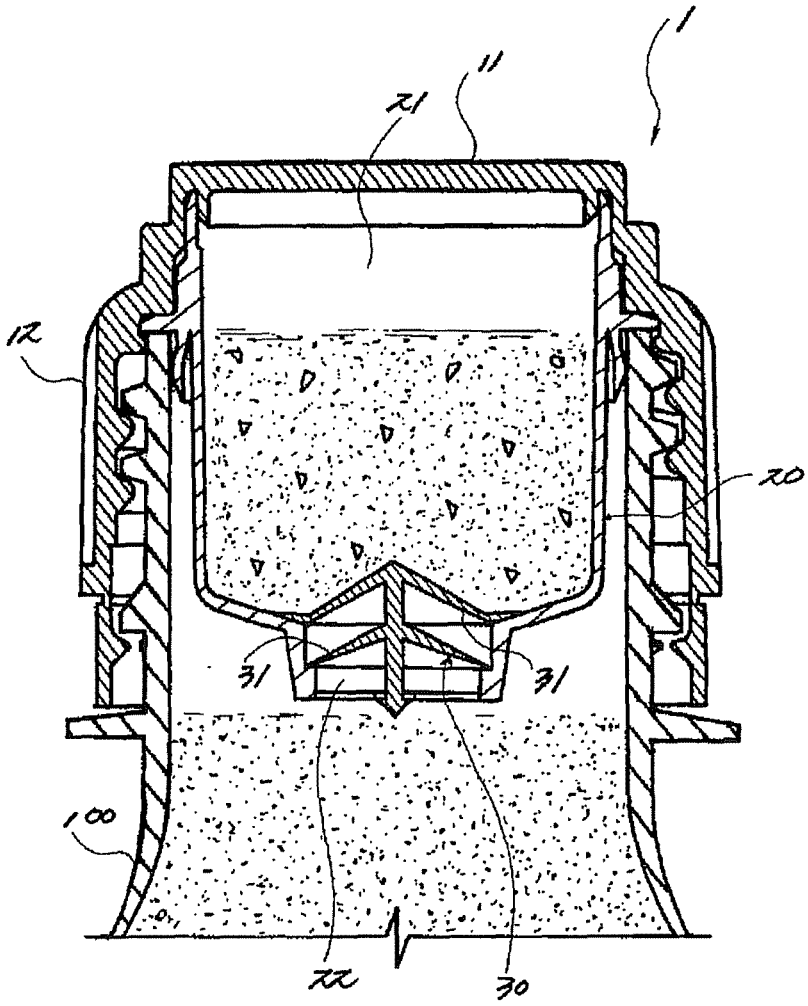
FIGS. 5 to 38 are cross-sectional views of a cap assembly in accordance with the various embodiments of the present invention.
Figure 6:
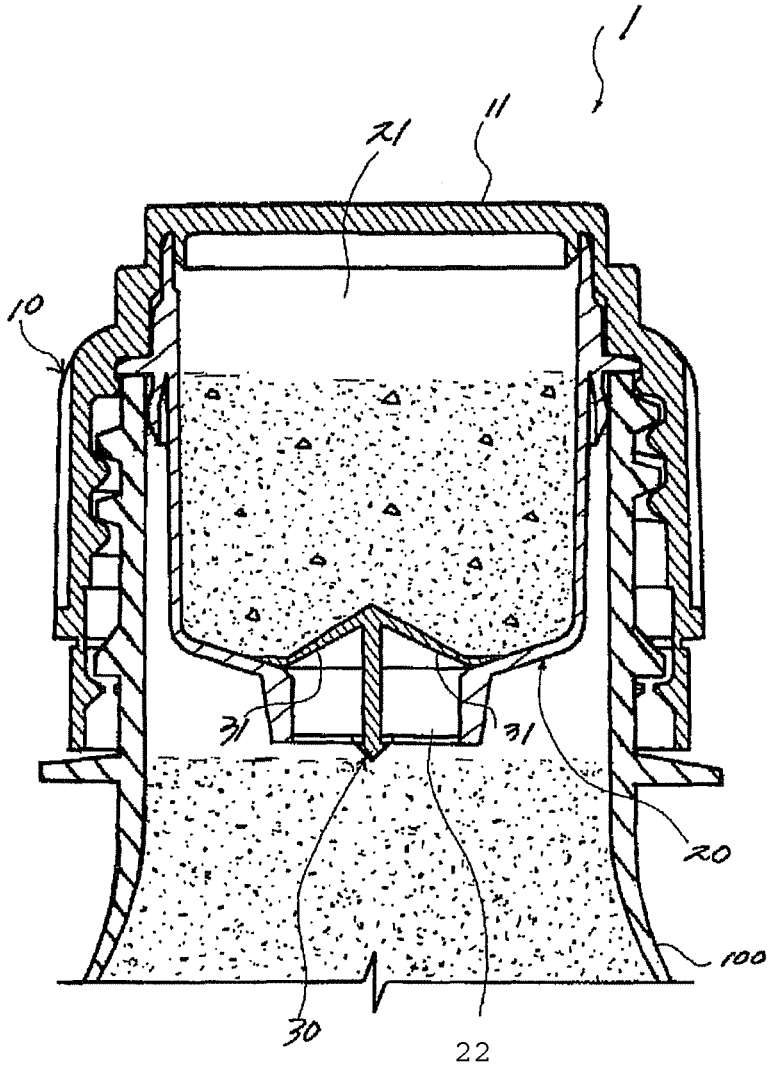
Figure 7:
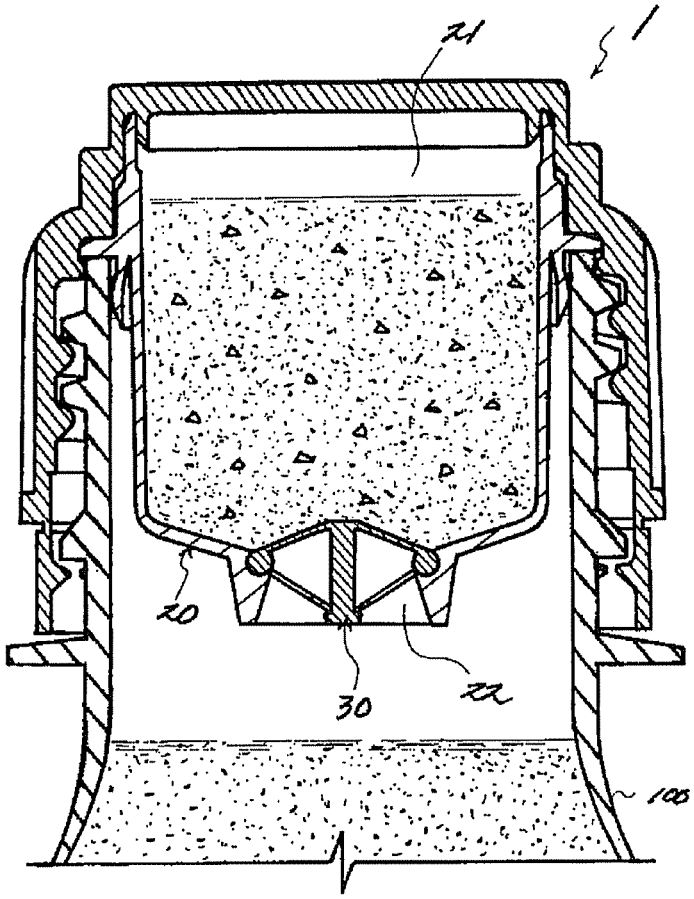
Figure 8:
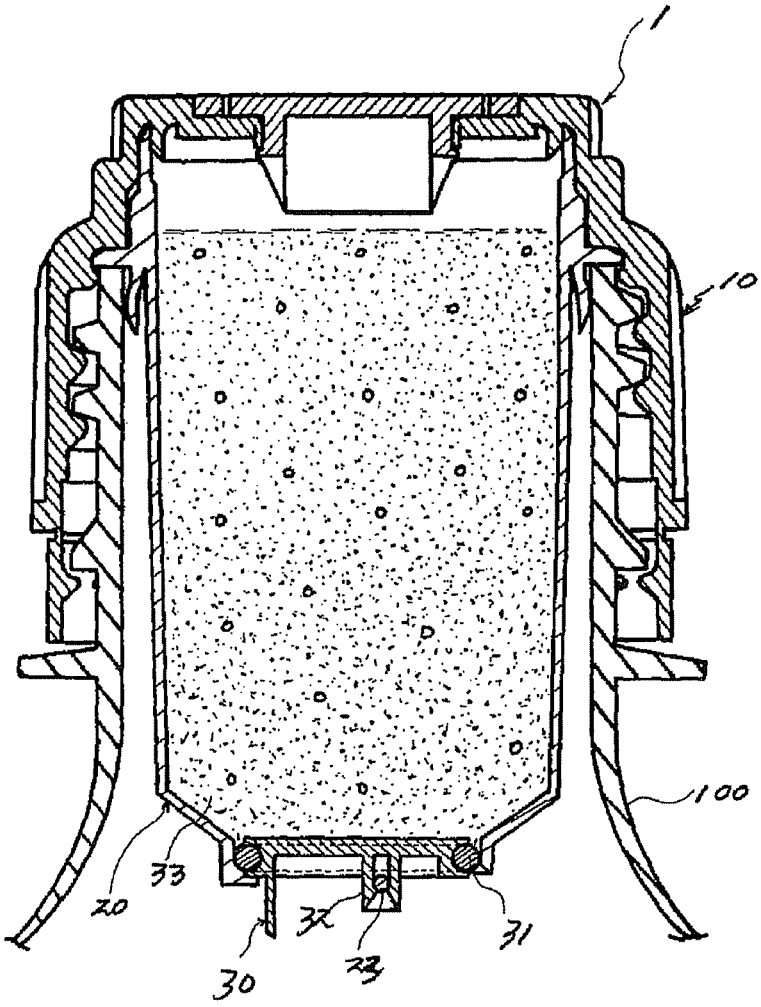

In FIGS. 5 to 7, it is shown that the respective valve-typed closing elements 30 are adapted to resiliently open the lower end opening of the housing under pressure.

In FIGS. 8 to 11, it is shown that the closing element 30 is adapted to be pivotally moved to open the lower end opening of the housing.

For the pivotal movement of the closing element 30, it is preferred that a pivot shaft 23 is transversely provided at the lower end opening 22 of the housing 20 and a protrusion 32 formed at the underside of the closing element and a separate sealing member 31 is provided at the periphery thereof.

Furthermore, the closing element 30 is provided with a stopper 33 so that the closing element moved to the opening position can not to return to the initial closing position.

Figure 9:
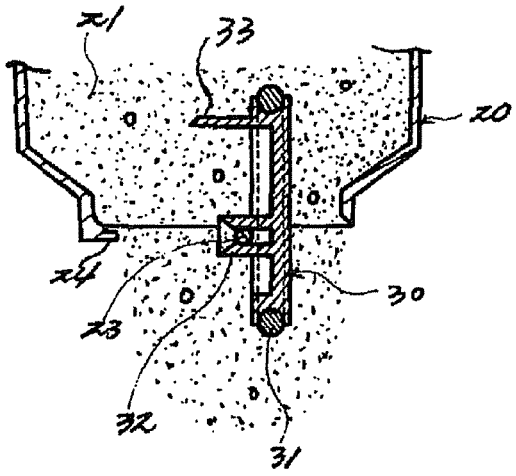
Figure 10:
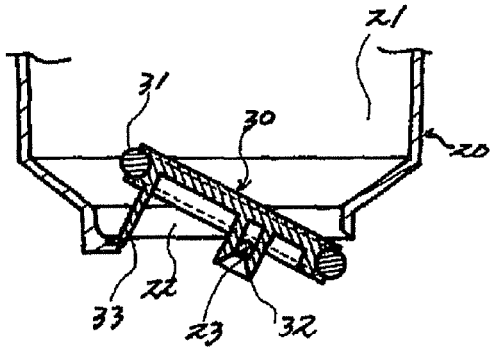

FIG. 9 shows the closing element 30 in an opening state and FIG. 10 shows the opened state of the lower end opening 22 is maintained by the stopper 33.

Figure 11:
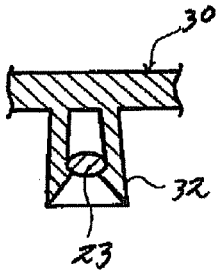

FIG. 11 shows the pivot shaft 31 has an oval-shaped section for resilient opening movement thereof.

Figure 12:
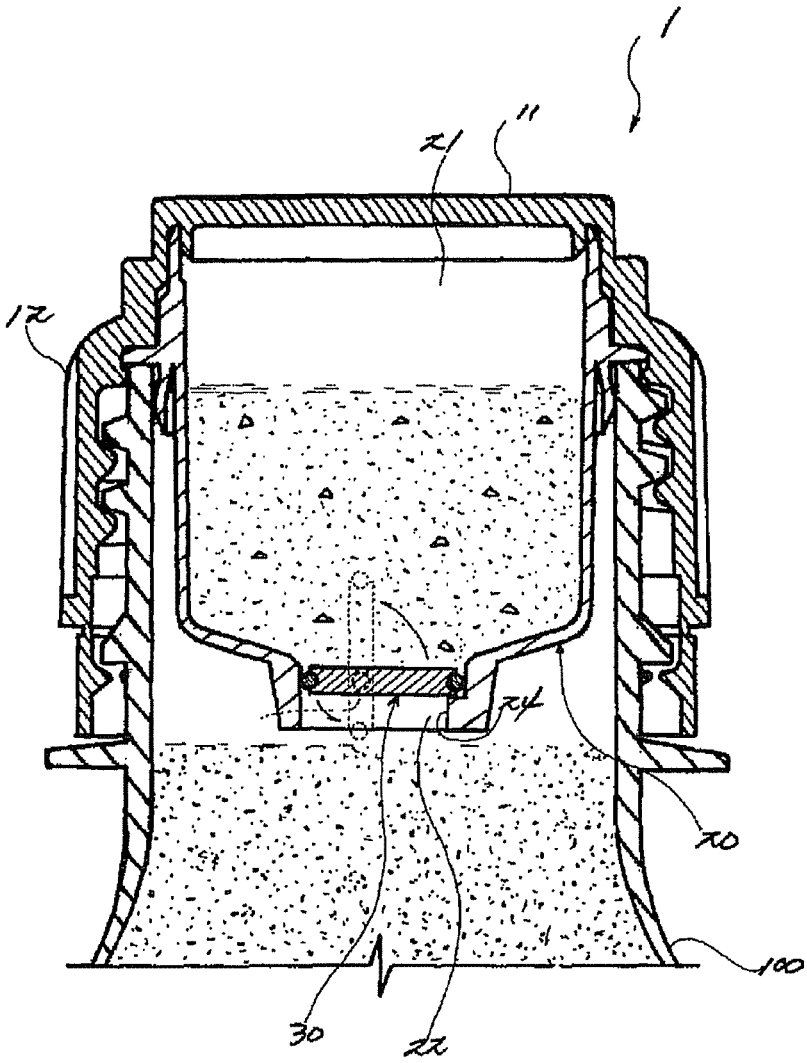

FIG. 12 shows that a shoulder 24 is formed at the lower end opening 22 to support the closing element 30 as shown in FIG. 9, thereby improving the sealing between the closing element and the opening.

Figure 13:
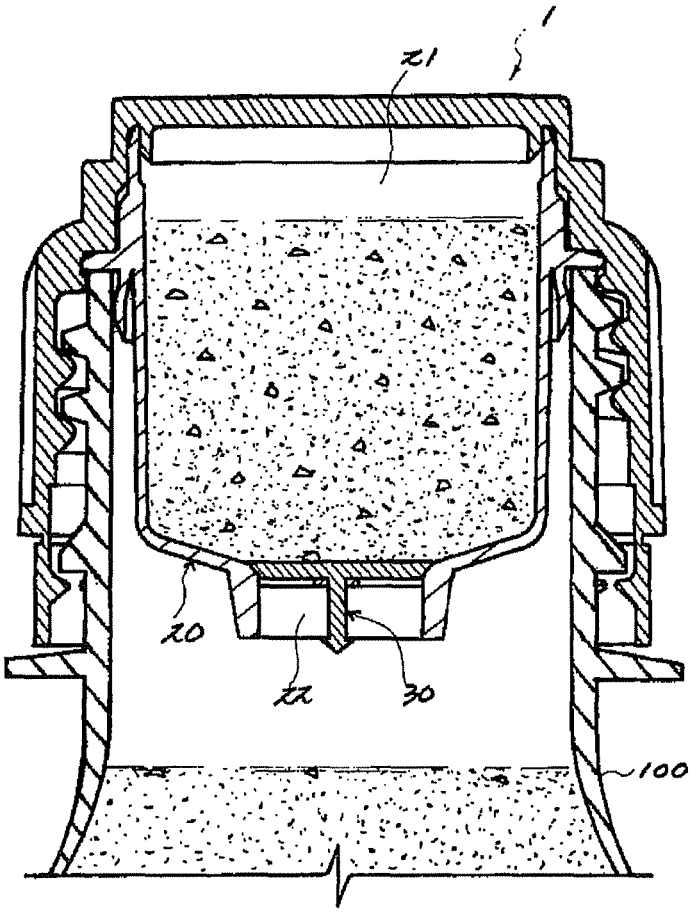

FIG. 13 shows a variant structure of the closing element 30, which is adapted to be maintained in an opened position.

Figure 14:
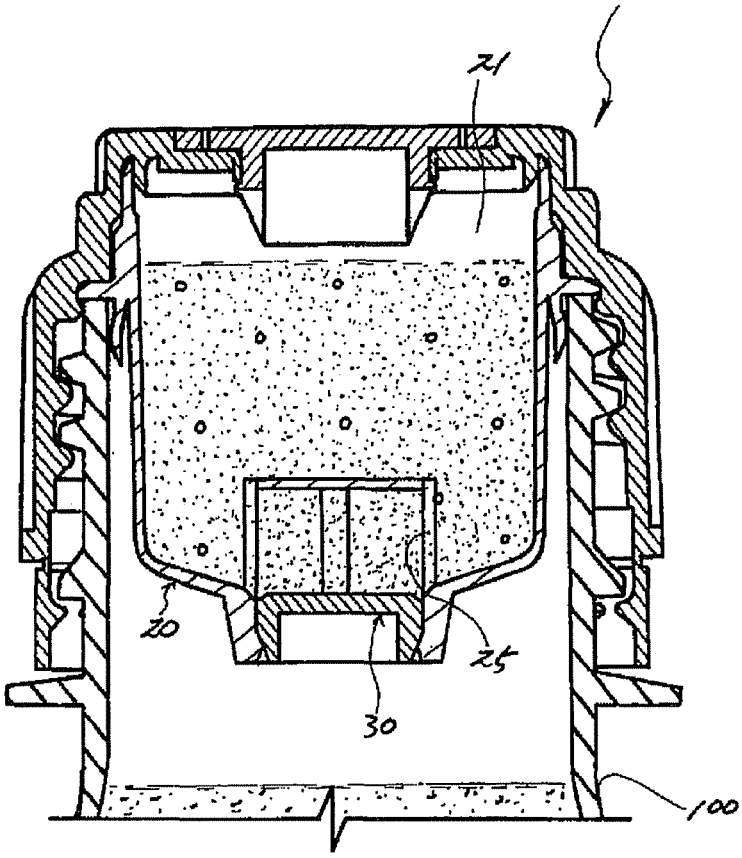

FIG. 14 shows that a mesh-typed maintaining member 25 is provided at the lower end opening 22 for maintaining the closing member 30 in an opening position so as to block the lower end opening.

Figure 15:
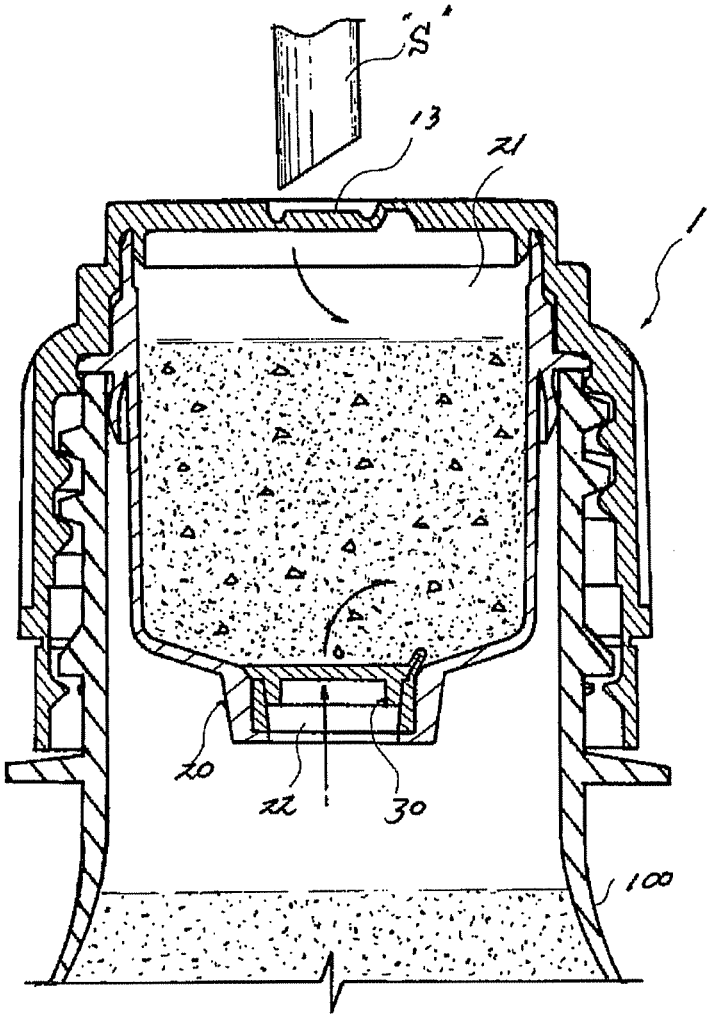

FIG. 15 shows a variant structure of the closing member 30, which comprises a boss portion engaged with the inside of the lower end opening and a movable portion connected to the boss portion so as to maintain the movable portion in an opening position.

The top portion is modified to have a weakened portion 13 for insertion of a straw (S).

Figure 16:
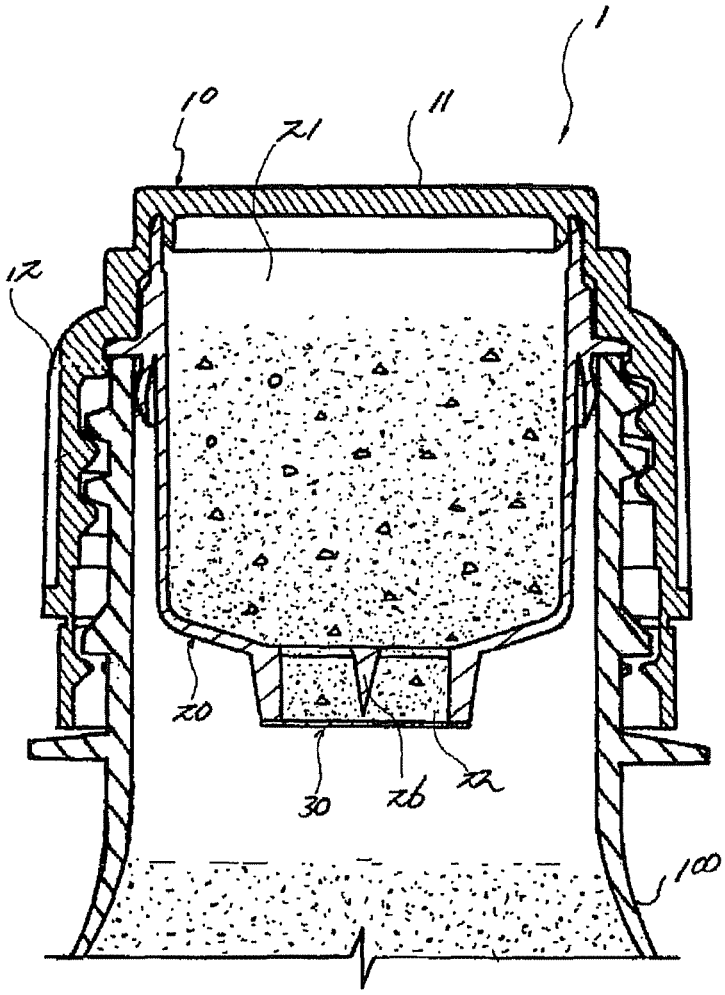

FIG. 16 shows an another embodiment of the cap assembly, which further comprises a punching pin 26 for rupturing a thin film-typed closing element 30, so that the punching pin 26 may rupture the thin-film closing element 30 under pressurization for opening the lower end opening 22.

Figure 17:
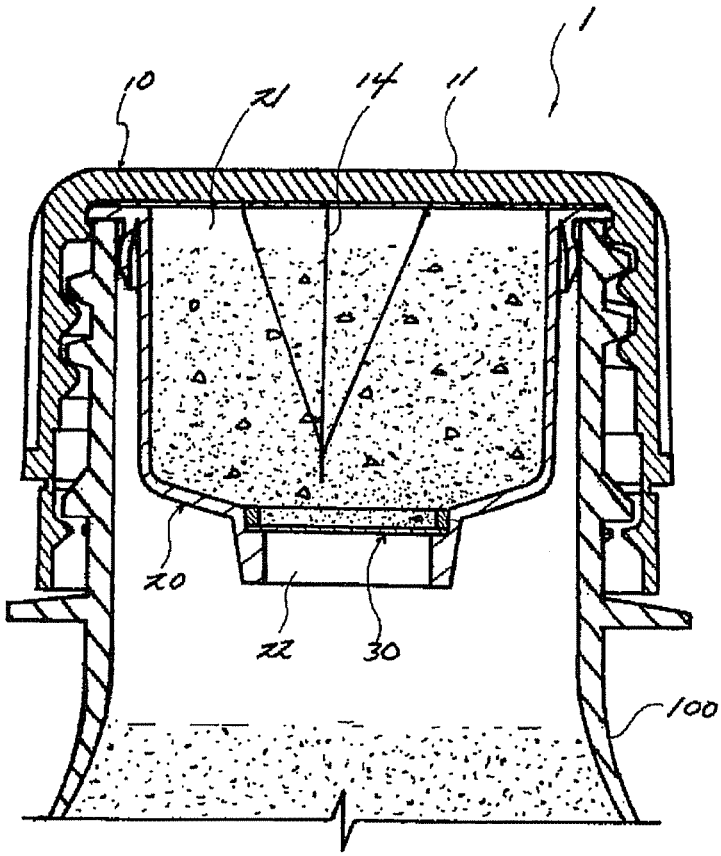

FIG. 17 shows a variant of the punching pin 14, which is different from that shown in FIG. 16 in that it is formed at the underside of the top portion 11 of the cap body 10.

Figure 18:
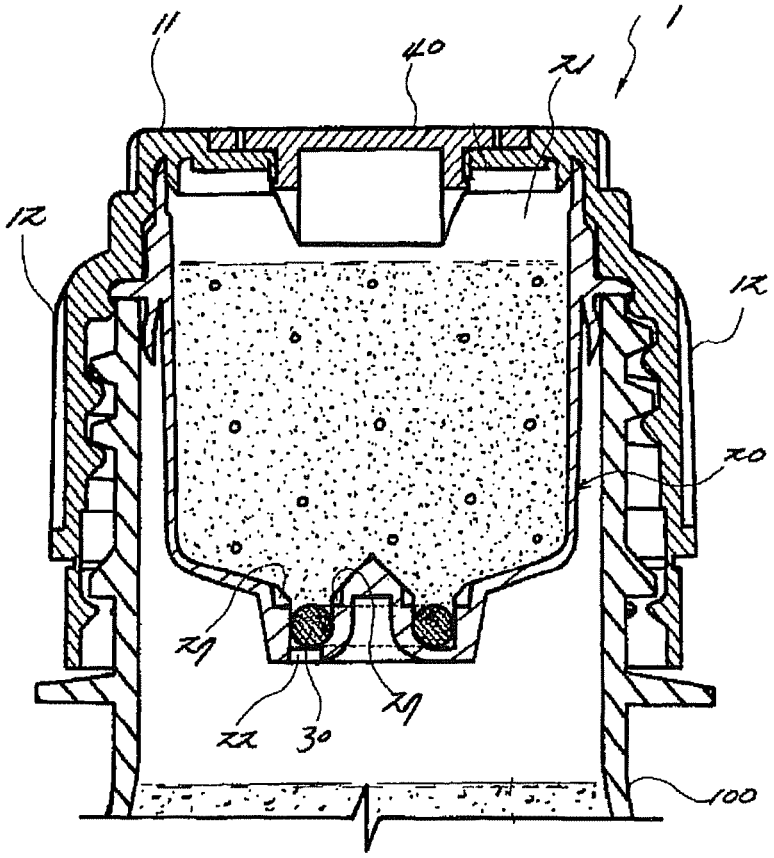

FIG. 18 shows a variant of the closing element 30, which has an O-ring shape. Preferably, the O-ring shaped closing element 30 is adapted not to return to the closing position by a shoulder 27 formed at the vicinity of the lower end opening 22.

Also, it is preferable to provide a separate plug 40 at the top portion of the cap body 10 for blocking an upper opening.

Figure 19:
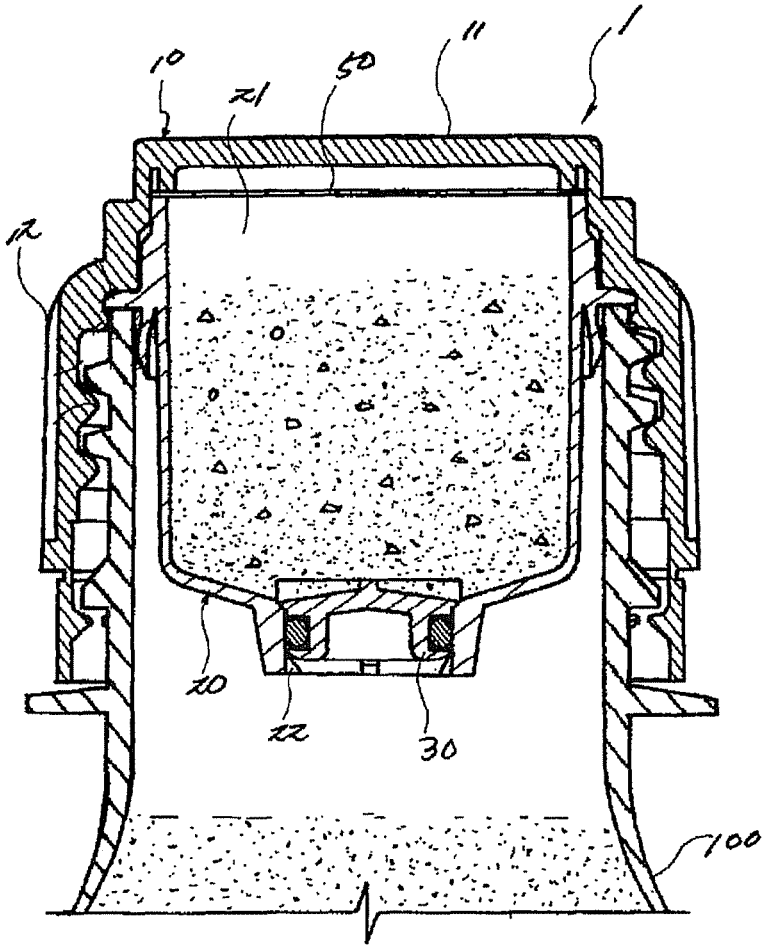

FIG. 19 shows a variant of the housing 20, which is adapted to cover the upper opening of the chamber by means of a sealing member 50.

Figure 20:
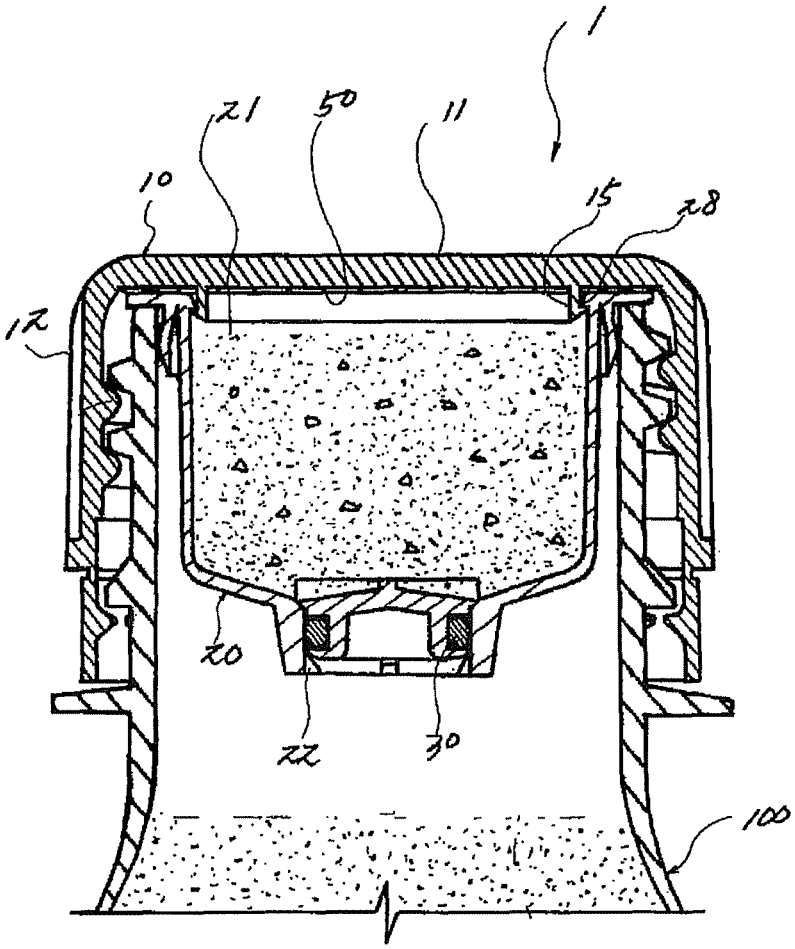

FIG. 20 shows a connection structure of the housing 20 and the cap body 10 by means of engaging shoulders 15 and 28 to improve the connection thereof.

Figure 21:
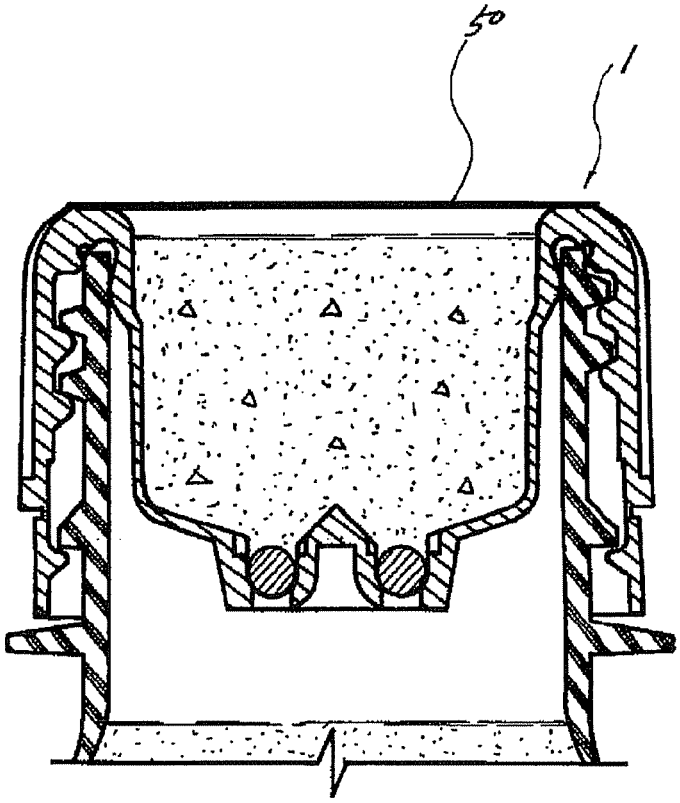

FIG. 21 shows a variant of the cap body 10, which is adapted to seal an upper opening of the cap body 10 by means of the sealing member 50.

Figure 22:
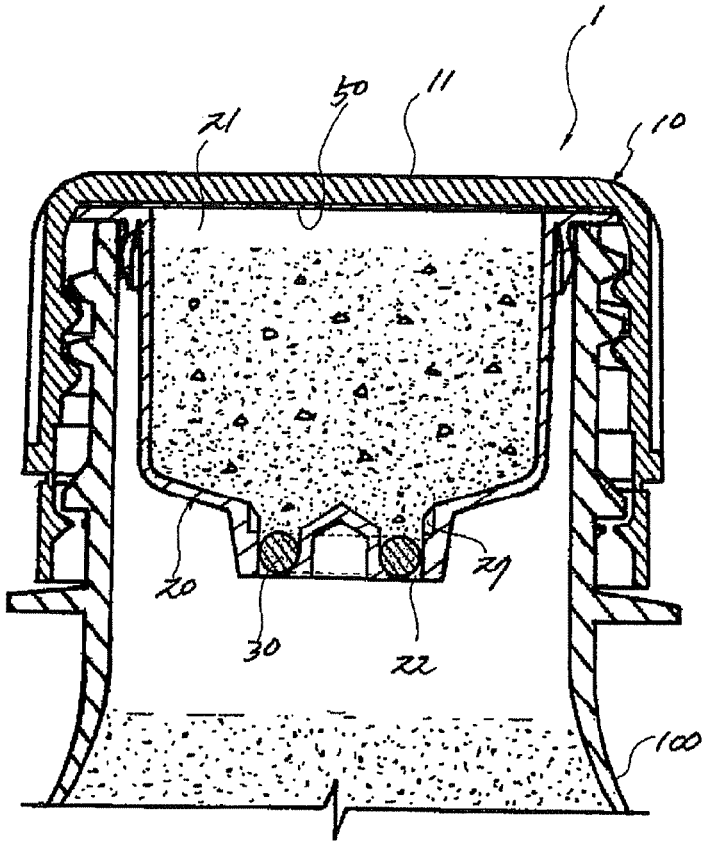

FIG. 22 shows another variant of the cap body 10 having a sealing structure by means of the sealing member 50.

Figure 23:
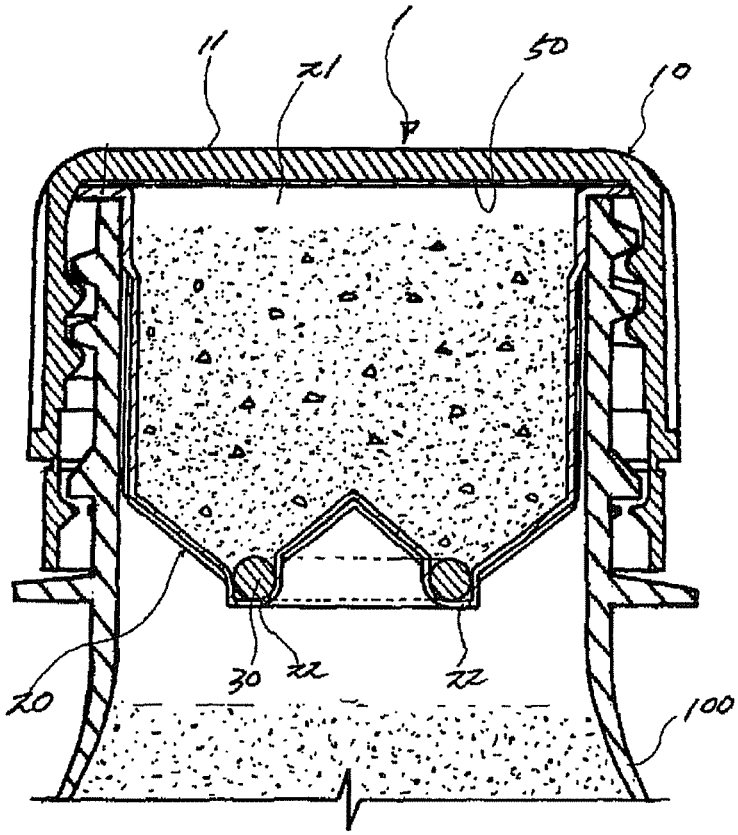

FIG. 23 shows another variant of the closing element 30 which is formed by extrusion.

Figure 24:
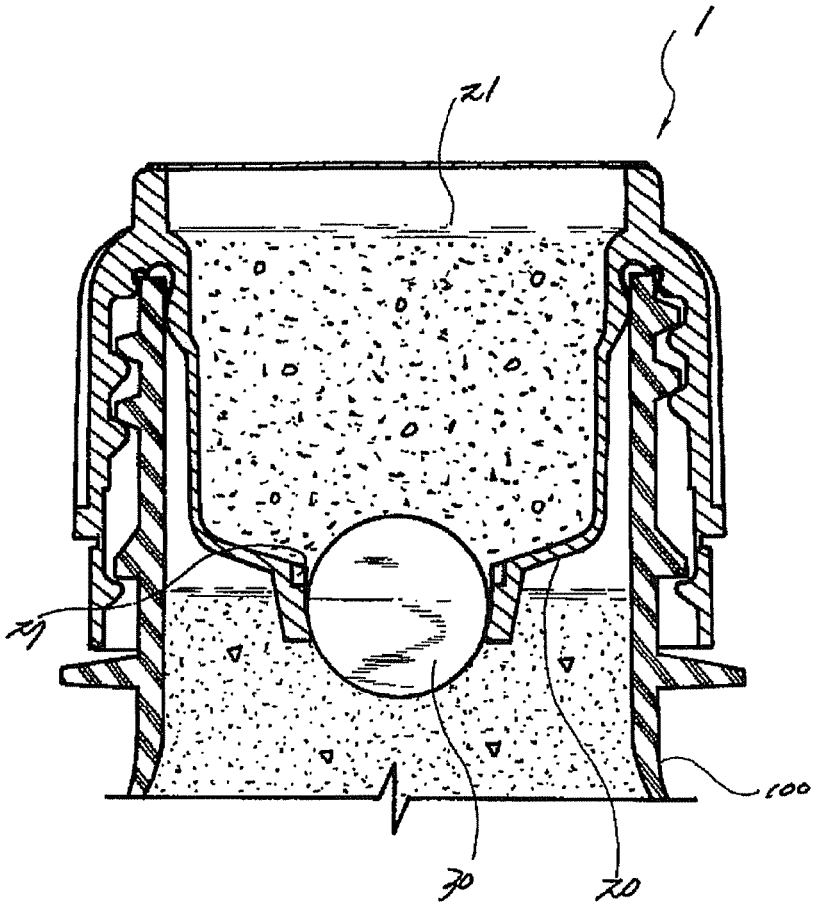
Figure 25:
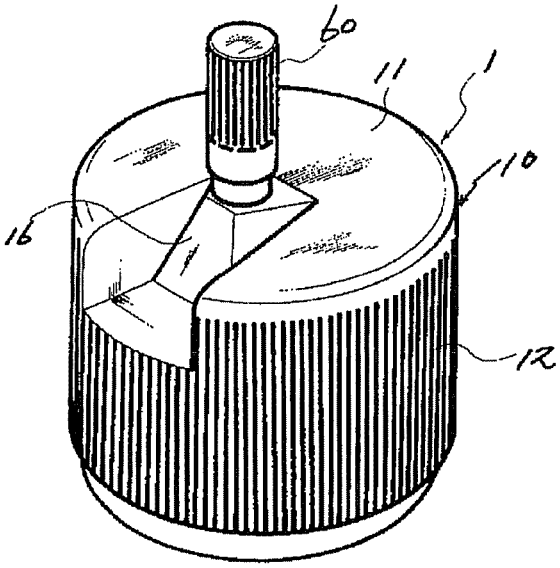
Figure 26:
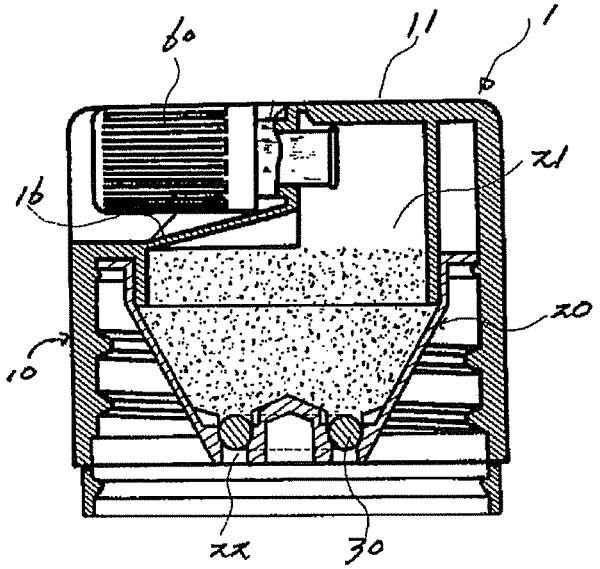
Figure 27:
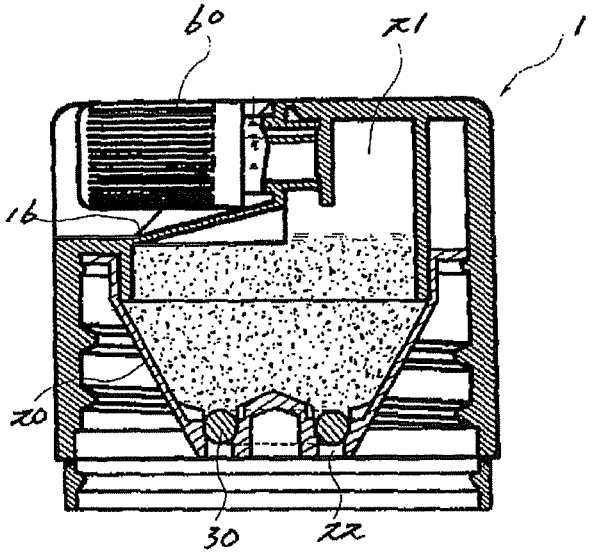
Figure 28:
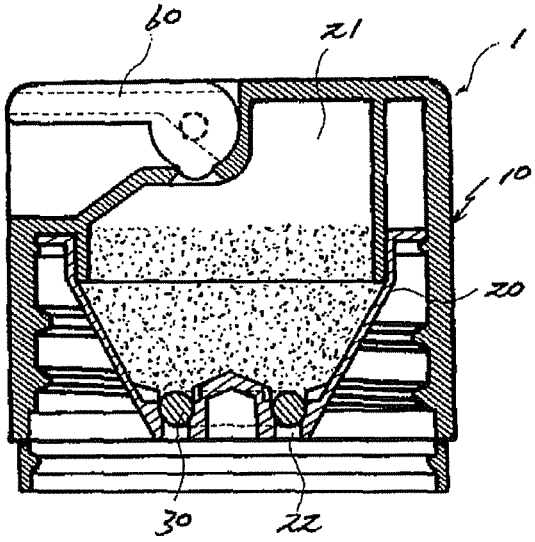

FIG. 24 shows another variant of the closing element 30 which is formed in a sphere shape.

FIGS. 25 to 28 show the uses of the cap assembly of the present invention in a container having a separate cap 60 or a collapsible structure, respectively.

Figure 29:
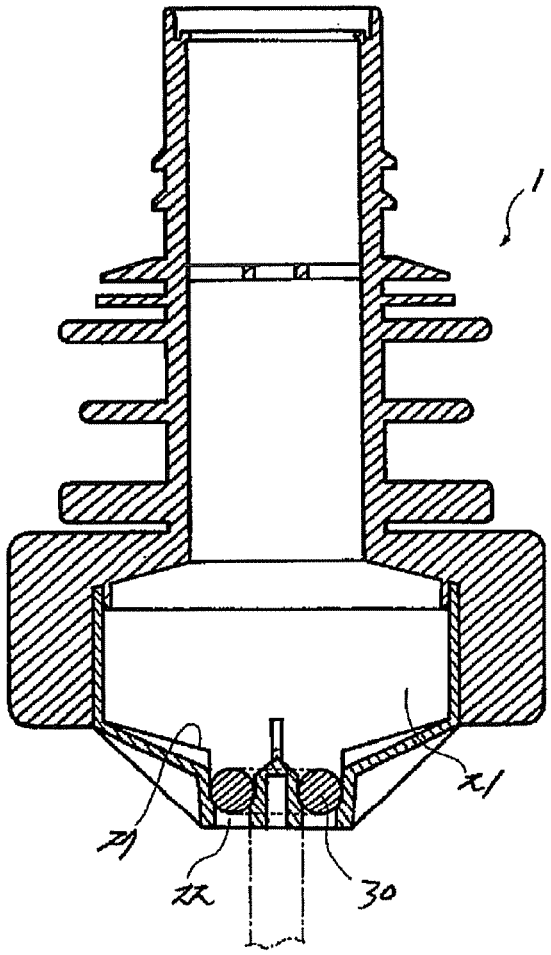

FIG. 29 shows the use of the cap assembly of the present invention at the discharging device of a pouch-typed container.

Figure 30:
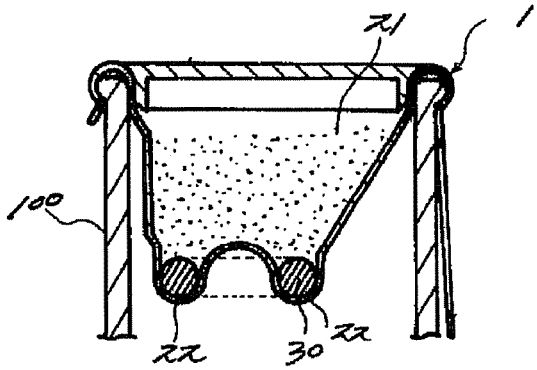
Figure 31:
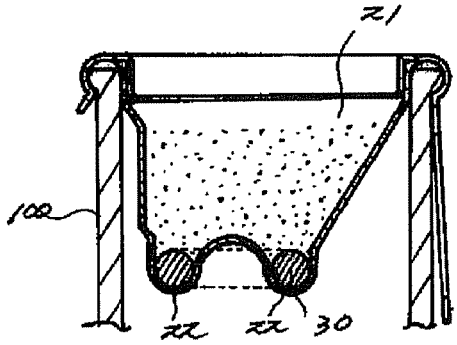
Figure 32:
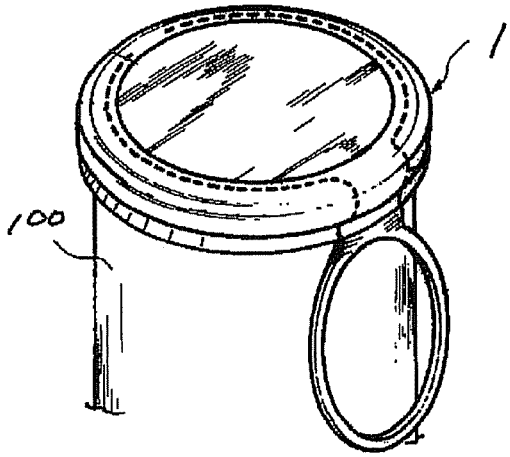

FIGS. 30 to 32 show the use of the cap assembly of the present invention as a cap in a type of snap-fit engagement.

Figure 33:
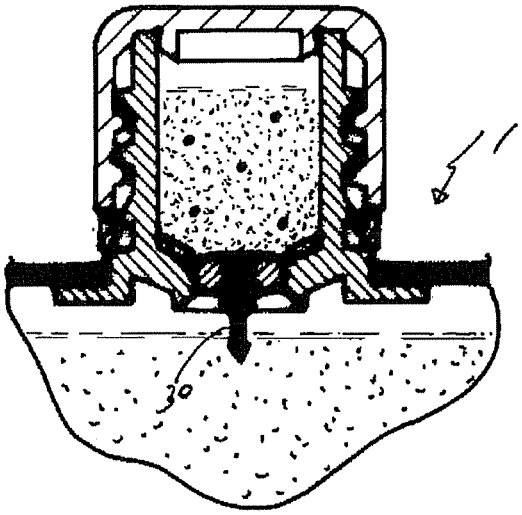
Figure 34:
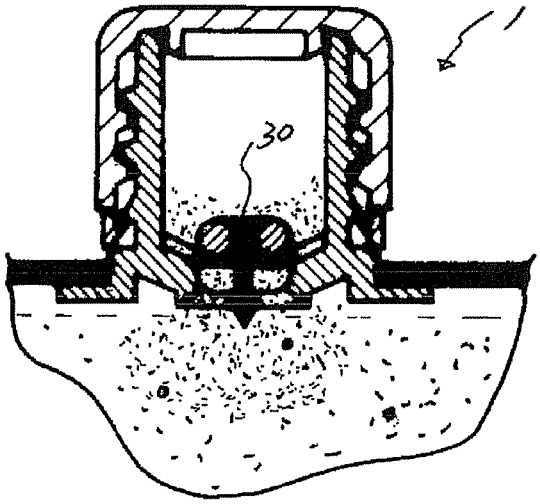

FIGS. 33 and 34 show the use of the cap assembly of the present invention at a paper pack.

Figure 35:
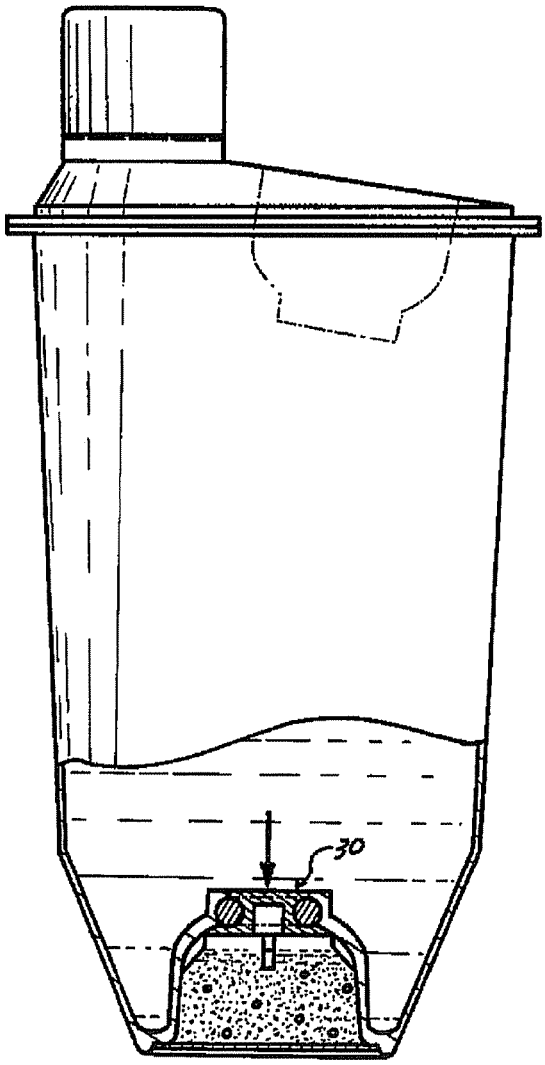
Figure 36:
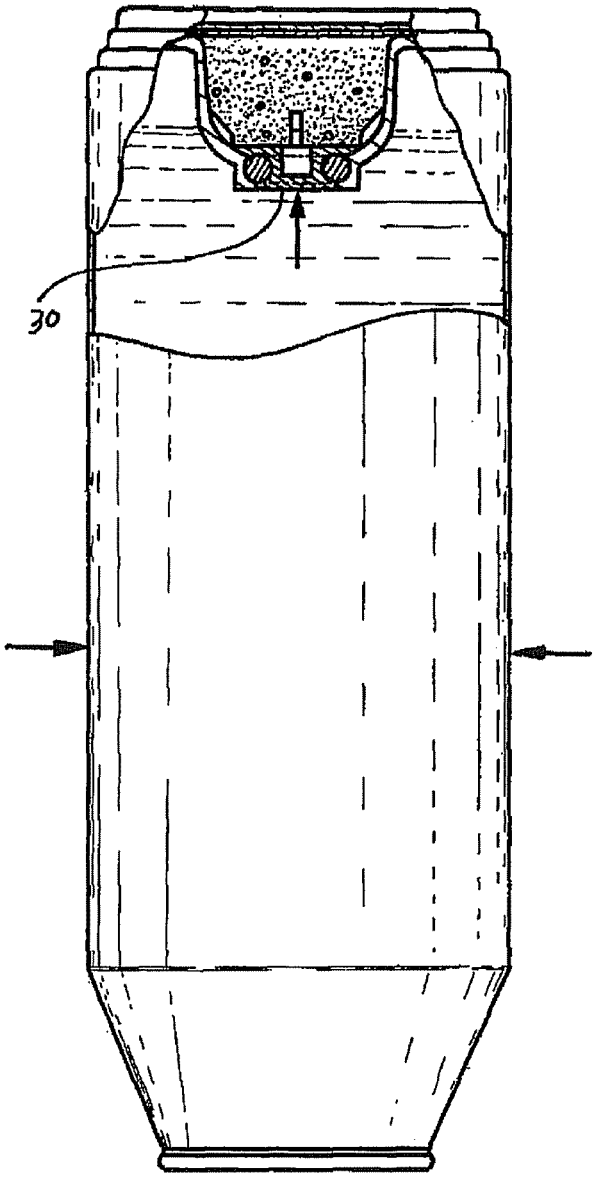

The cap assembly of the present invention may be adopted at a bottom of a container as shown in FIG. 35 and at a cap of a can as shown in FIG. 36.

Figure 37:
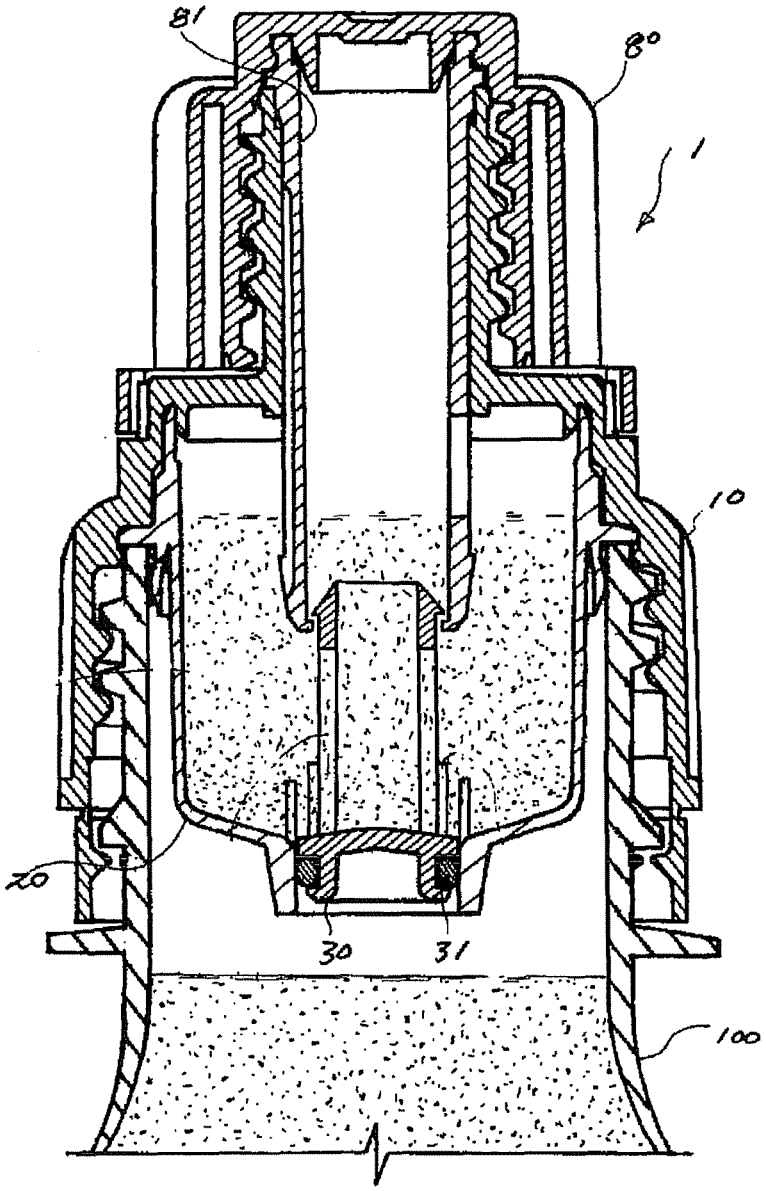
Figure 38:
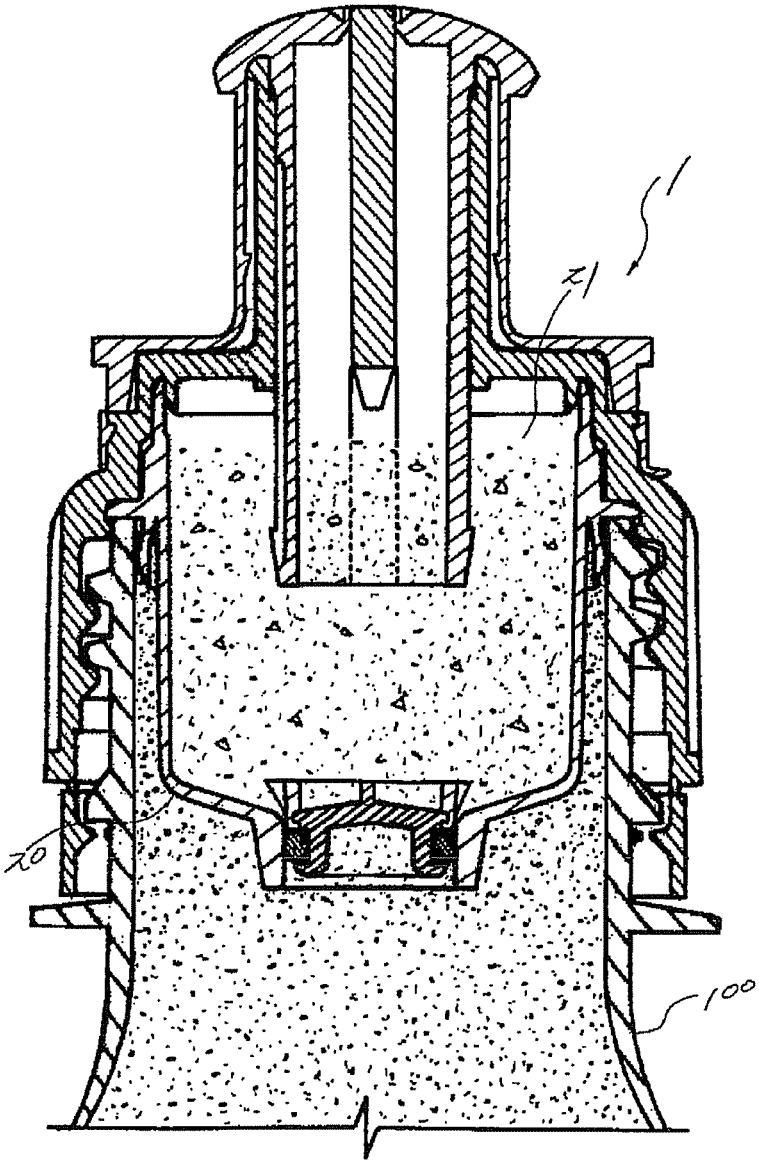

FIGS. 37 and 38 show an adoption of he cap assembly of the present invention at a discharging device of the container 1, respectively.

For example, as shown in FIG. 37, when the cap 80 is opened, the discharging device 81 is raised and then the lower end opening 22 may be opened by pulling the closing element 30 or be opened by pressing the container.

Alternatively, the closing element 30 of the present invention may be adopted to the container 1 having the discharging device 81.

Industrial Applicability

As apparent from the above description, the cap assembly of the present invention may be adapted to accommodate a concentrate liquid or a granule to be mixed which a water, a beverage or other liquid in the container with an easy and improved mixing two different materials, which may be advantageous in the various industrial fields such as medical, pharmaceutical, cosmetic and etc.

While the preferred embodiment in accordance with the present invention has been shown and described, equivalent modifications and changes known to persons skilled in the art according to the present invention are considered to be within the scope of the present invention as defined in the appended claims.

The invention claimed is:

1. A container and cap assembly, the cap assembly mounted on a discharging portion of the container for containing an ingredient different from that contained in a container, comprising:

a beverage contained in the container;

a cap body having a housing formed with a chamber for storage of a secondary ingredient, the cap body threadably coupled to a neck of the container, the housing containing a secondary ingredient which is different from the beverage;

a closing element provided at a lower end opening of the housing for sealing the lower end opening, wherein the closing element moves into the housing and in a direction away from the container and the beverage due to pressure within the container increasing thereby allowing the secondary ingredient to exit the housing and enter the container, the cap body and the container fixedly attached to prevent relative movement therebetween.

2. A cap assembly in accordance with claim 1, wherein the housing is assembled to the cap body.

3. A container and cap assembly, the cap assembly mounted on a discharging portion of the container for containing an ingredient different from that contained in a container, comprising:

a beverage contained in the container;

a cap body having a housing formed with a chamber for storage of a secondary ingredient, the cap body threadably coupled to a neck of the container, the housing containing a secondary ingredient which is different from the beverage;

a closing element provided at a lower end opening of the housing for opening the lower end opening under pressure, so that the secondary ingredient may be discharged into the container so as to be mixed with a primary ingredient in the container, wherein the closing element moves into the housing and in a direction away from the container and the beverage in response to an increase in pressure within the container and the secondary ingredient exits the housing and enters the container, the cap body and the container fixedly attached to prevent relative movement between the housing and the neck of the container while the closing element moves into the housing.

4. A cap assembly in accordance with claim 3, wherein when the container is pressed, the closing element sealing the lower end opening is raised for opening a lower end opening so as to discharge the secondary ingredient through the lower end opening to be mixed with the primary ingredient in the container.

5. The cap assembly in accordance of claim 1 including a sealing member on the closing element configured to seal the closing element to the housing thereby preventing the secondary ingredient from mixing with the beverage.

6. The cap assembly in accordance of claim 3 including a sealing member on the closing element configured to seal the closing element to the housing thereby preventing the secondary ingredient from mixing with the beverage.

* * * * *